US007195584B1

(12) United States Patent
Lu et al.

(10) Patent No.: US 7,195,584 B1
(45) Date of Patent: Mar. 27, 2007

(54) EXERCISE APPARATUS FOR RESISTANCE TRAINING

(75) Inventors: Zhi Lu, West Dundee, IL (US); Mark C. Termion, Winfield, IL (US); Eric C. White, Streamwood, IL (US)

(73) Assignee: Brunswick Corporation, Lake Forest, IL (US)

( * ) Notice: Subject to any disclaimer, the term of this patent is extended or adjusted under 35 U.S.C. 154(b) by 252 days.

(21) Appl. No.: 10/894,936

(22) Filed: Jul. 20, 2004

(51) Int. Cl.
*A36B 21/045* (2006.01)
*A36B 21/02* (2006.01)

(52) U.S. Cl. ..... 482/127; 482/121; 482/92; 482/136

(58) Field of Classification Search ..... 482/91, 482/99, 126, 127, 45, 46, 118, 115, 136, 137
See application file for complete search history.

(56) References Cited

U.S. PATENT DOCUMENTS

| | | | | |
|---|---|---|---|---|
| 3,124,342 | A | 3/1964 | Ormond | |
| 3,167,312 | A * | 1/1965 | Blanchard | 482/128 |
| 3,752,475 | A | 8/1973 | Ott | |
| 4,721,930 | A | 1/1988 | Cohen | |
| 4,746,113 | A | 5/1988 | Kissel | |
| 4,753,434 | A * | 6/1988 | Salvino | 482/49 |
| 4,909,505 | A | 3/1990 | Tee | |
| 4,911,437 | A * | 3/1990 | Schulkin | 482/124 |
| 5,041,060 | A | 8/1991 | Hendershot | |
| 5,046,727 | A * | 9/1991 | Wilkinson et al. | 482/45 |
| 5,062,619 | A | 11/1991 | Sato | |
| 5,209,461 | A | 5/1993 | Whightsil, Sr. | |
| 5,273,507 | A * | 12/1993 | Sivula | 482/126 |
| 5,611,524 | A | 3/1997 | Gordon | |
| 5,632,710 | A | 5/1997 | England et al. | |
| 6,241,224 | B1 | 6/2001 | Leibman | |
| 6,368,259 | B1 | 4/2002 | Liao et al. | |
| 6,440,044 | B1 * | 8/2002 | Francis et al. | 482/114 |
| 6,482,139 | B1 | 11/2002 | Haag | |
| 2002/0025891 | A1 | 2/2002 | Colosky, Jr. et al. | |
| 2003/0203796 | A1 * | 10/2003 | Yu | 482/98 |

FOREIGN PATENT DOCUMENTS

| | | |
|---|---|---|
| JP | 09215772 | 8/1997 |

* cited by examiner

*Primary Examiner*—Stephen R. Crow
*Assistant Examiner*—Allana Lewin
(74) *Attorney, Agent, or Firm*—Andrus, Sceales, Starke & Sawall, LLP

(57) ABSTRACT

Exercise apparatus for resistance training includes a first disk rotational about an axis, a second disk axially aligned with the first disk and resisting rotation about the axis, and a resiliently deformable coupling coupled between the first and second disks and tensionable in a spiral about the axis upon rotation of the first disk about the axis, such that rotation of the first disk about the axis tensions and stretches the coupling along a spiral and is resisted by the second disk.

30 Claims, 5 Drawing Sheets

EXERCISE APPARATUS FOR RESISTANCE TRAINING

BACKGROUND AND SUMMARY

The invention relates to exercise apparatus for resistance training, and more particularly to the resistance mechanism or strength engine.

Exercise apparatus for resistance training, including cardiovascular exercise/training, employ various resistance mechanisms, including a weight stack and various biasing means opposing a given direction of movement. The present invention provides exercise apparatus with a simple, effective resistance mechanism.

DETAILED DESCRIPTION

Figure 1:
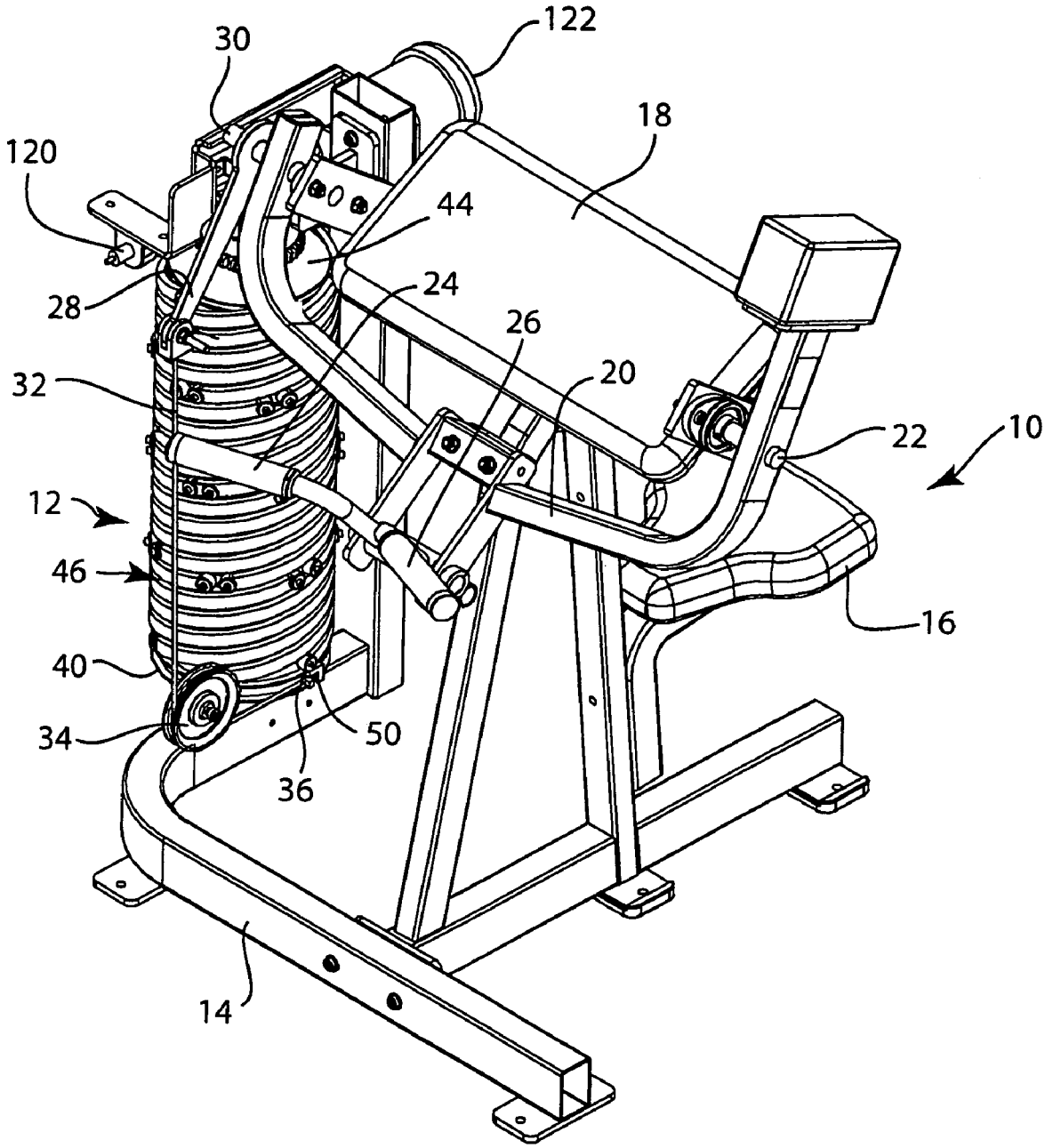
FIG. 1 is a perspective view of one form of exercise apparatus in accordance with the invention.

FIG. 1 shows one form of exercise apparatus 10 having a resistance mechanism 12. The exercise apparatus shown is a seated arm curl machine having a frame 14 resting on the floor and supporting a seat 16 for the user, an upper arm pad 18, an arm bar 20 pivoted about axis 22 and having grip handles 24, 26 for gripping by the user for an upward pulling curling motion in an arc about axis 22, all as is known. A lever 28, or alternatively an eccentric cam, is fixed to arm 20 and/or pivot rod or axle 30 along axis 22 and pivots with arm 20 to pull cable 32 upwardly, which cable is trained around pulley 34 and is connected at cable end 36 to resistance mechanism 12. Various resistance mechanisms are known in the prior art for resisting movement of the cable, to provide strength training, including cardiovascular training/exercise, such as weight stacks and various biasing mechanisms. Resistance mechanism 12 may be used with various types of exercise apparatus for resistance training, including cardiovascular training/exercise. The arm curl machine is exemplary only.

Figure 2:
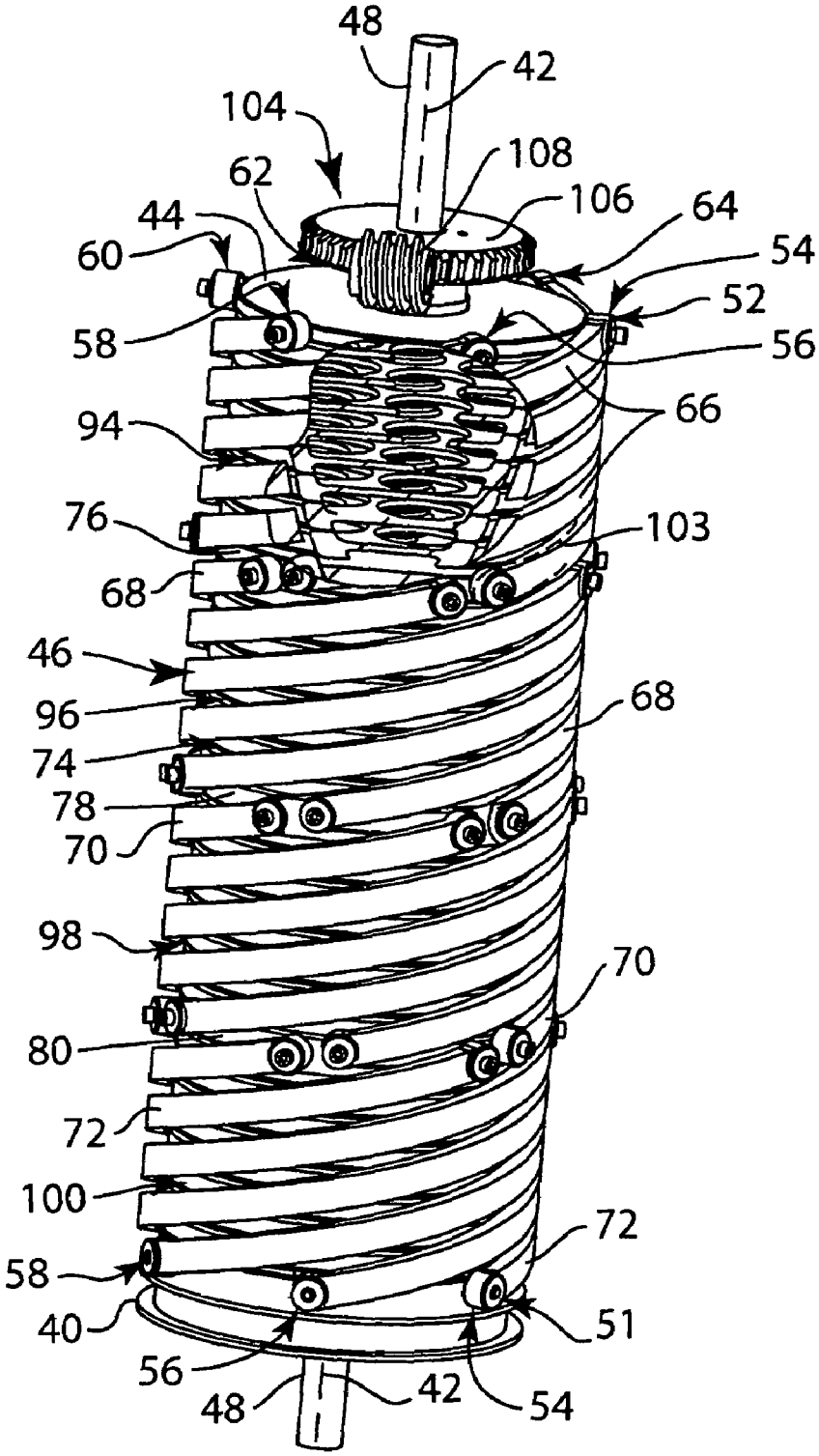
FIG. 2 is an enlarged perspective view of a portion of FIG. 1 showing the resistance mechanism.
Figure 3:
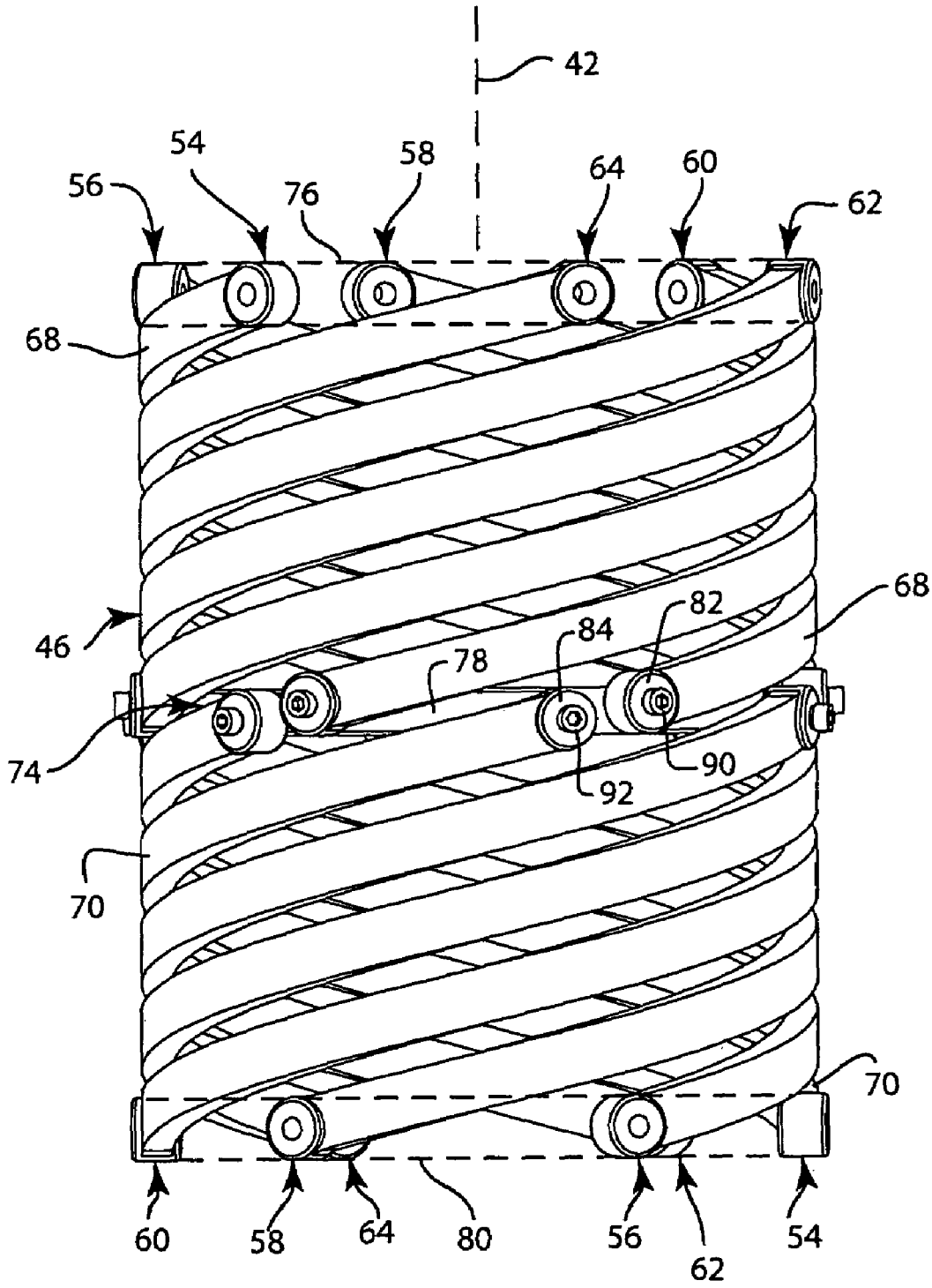
FIG. 3 is an enlarged perspective view of a portion of FIG. 2.
Figure 4:
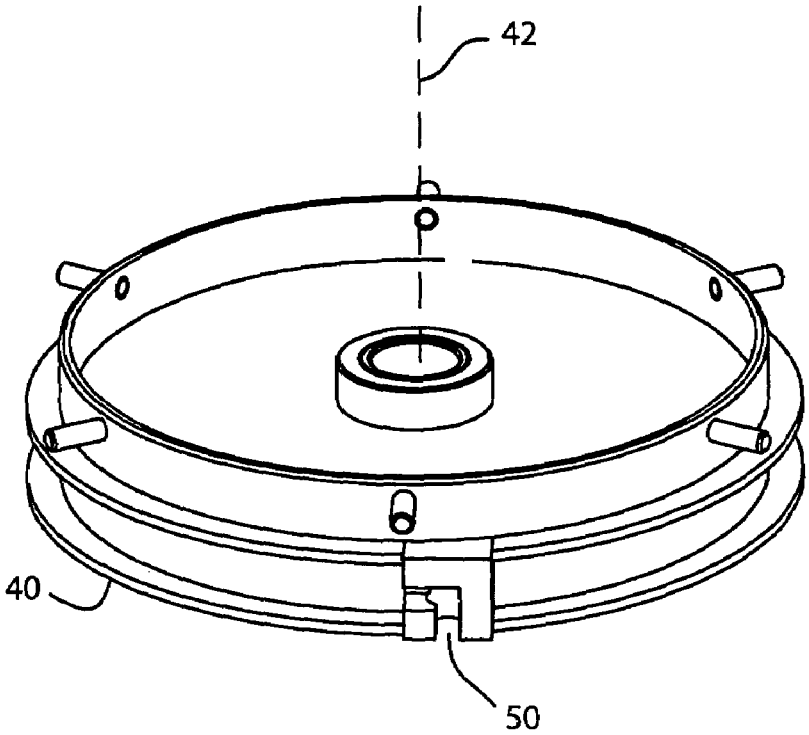
FIG. 4 is a perspective view of a component of FIG. 2.
Figure 5:
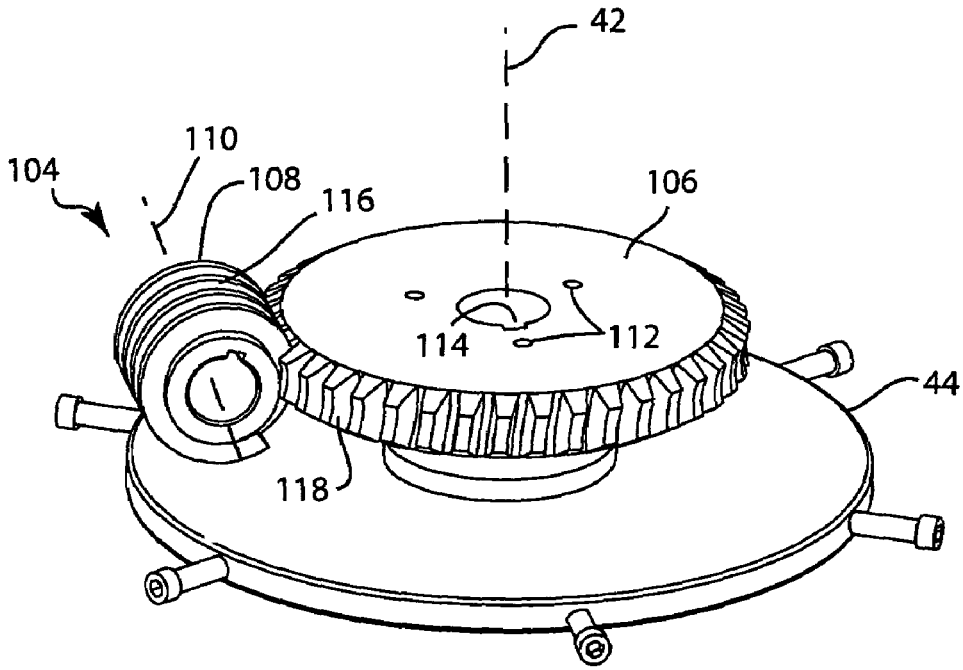
FIG. 5 is a perspective view of a component of FIG. 2.
Figure 6:
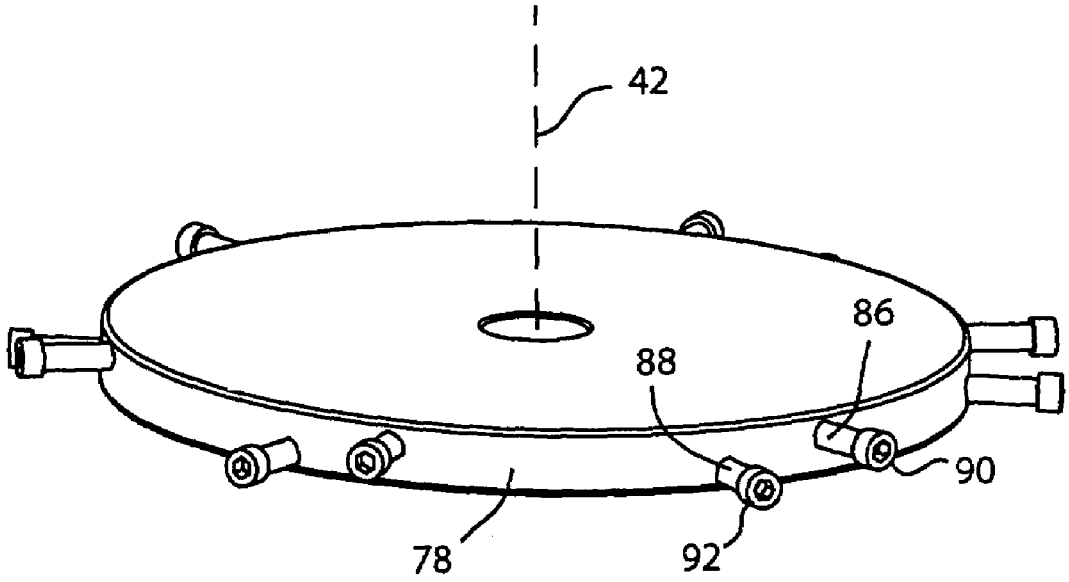
FIG. 6 is a perspective view of a component of FIG. 2.
Figure 7:
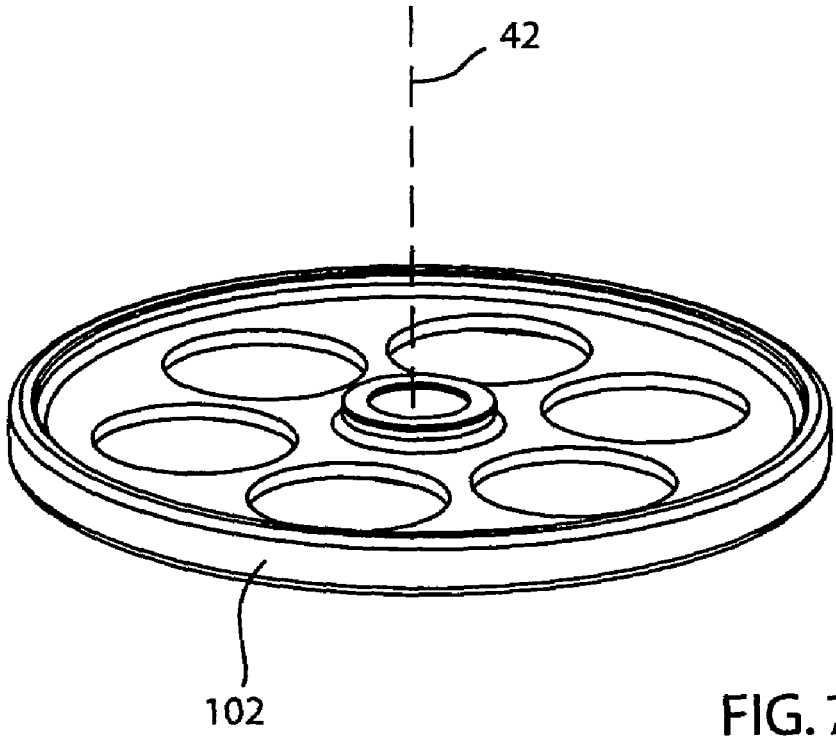
FIG. 7 is a perspective view of a component of FIG. 2.

Resistance mechanism 12 of the exercise apparatus includes a first disk 40, FIGS. 1, 2, 4, rotational about an axis 42, a second disk 44, FIGS. 1, 2, 5, axially aligned with first disk 40 and resisting rotation about axis 42, and a resiliently deformable coupling 46 coupled between disks 40 and 44 and tensionable in a spiral about axis 42 upon rotation of disk 40 about axis 42, such that rotation of first disk 40 about axis 42 tensions and stretches coupling 46 along the noted spiral and is resisted by second disk 44. In the preferred embodiment, each of disks 40 and 44, and a plurality of intermediate disks therebetween, to be described, are mounted on a common axially extending shaft 48 extending longitudinally along axis 42 and supported on frame 14. In other embodiments, each of disks 40 and 44 is mounted on its own separate shaft, and such intermediate disks are merely nested within each other along a virtual shaft, to be described. The various disks are preferably round, but may have other shapes. Cable end 36 is retained in slot or cavity

50 in disk 40 such that the latter is linked by cable 32, pulley 34 and lever 28 to arm 20 of the training member, such that movement of training member arm 20 by the user in the noted arc about axis 22 rotates disk 40 about axis 42 tensioning and stretching coupling 46 along the noted spiral which is resisted by disk 44. Disk 44 has a fixed, or at least resistive, rotational position about axis 42, to be described. In the rest position, coupling 46 may or may not be in a spiral.

Coupling 46 has a first end 51, FIG. 2, coupled to first disk 40, and a second end 52 coupled to second disk 44. In one embodiment, coupling 46 is provided by a plurality of sets 54, 56, 58, 60, 62, 64 of resiliently deformable stretchable bands wrapped in parallel about axis 42. It is preferred that the bands be both functionally and geometrically in parallel about axis 42. Each set has a plurality of stretchable bands extending end-to-end in series and wrapped around intermediate disks, to be described. For example, set 54 has stretchable bands 66, 68, 70, 72 extending end-to-end in series, set 56 also has four stretchable bands extending end-to-end in series, and so on. The bands are connected to respective disks, to be described.

A plurality of intermediate disks 74, FIGS. 2, 3, 6, 7, are provided between disks 40 and 44. The intermediate disks include a first set of connection disks 76, 78, 80 axially spaced from each other and providing connection points for the ends of respective bands. For example, bands 68 and 70, FIG. 3, extend in series relation and are connected end-to-end in series connection at ends 82 and 84 at intermediate connection disk 78. The ends of the bands have apertures therethrough for mounting on respective studs such as 86 and 88, FIG. 6, of a respective disk such as 78, and are held thereon by an allen hex nut or the like such as 90 and 92. Other ends of respective bands are connected to respective disks in like manner. The noted intermediate disks also include a plurality of sets 94, 96, 98, 100 of spacer disks. Each set of spacer disks includes a plurality of disks such as 102, FIG. 7. The plurality of spacer disks 102 in set 94 are between disks 44 and 76. The plurality of spacer disks 102 in set 96 are between intermediate disks 76 and 78. The plurality of spacer disks 102 in set 98 are between intermediate disks 78 and 80. The plurality of spacer disks 102 in set 100 are between disks 80 and 40. For clarity, the spacer disks are not shown in FIG. 3, and in FIG. 2 are only shown in the broken away portion thereof. In band set 54, FIG. 2, the lower end of band 72 is connected to disk 40, and the upper end of band 66 is connected to disk 44. The upper end of band 72 is coupled to the lower end of band 66, either by direct connection thereto (in which case intermediate connection disk 78 and spacer disk sets 96 and 98 are eliminated), or by connection through an intermediate connection disk, or through one or more additional stretchable bands such as 70, 68 in combination with one or more intermediate connections disks. The intermediate disks 74 are axially aligned with and axially interposed between the noted first and second disks 40 and 44. The bands may be connected to respective disks as shown at a terminal end of a band, or alternatively the band may be looped around a respective connection such as 86 at any of disks 40, 44, 76, 78, 80 in serpentine manner, for example as shown at dashed line loop 103.

An adjustment mechanism 104, FIGS. 2, 5, is provided for adjustably controlling the position of disk 44 relative to the spiral to selectively increase or decrease spiral tension along coupling 46 to vary resistance to rotation of first disk 40, and hence vary the resistance to upward curling of training member arm 20 and handles 24, 26. Adjustment mechanism 104 adjustably controls the rotational position of disk 44 about axis 42. The adjustment mechanism includes a toothed gear 106 fixed to disk 44 and rotational therewith about axis 42, and an adjustment gear 108 rotational about a second axis 110 transverse to axis 42. Gear 106 is a toothed gear fixed to disk 44 by welding or by pins or bolts such as 112 or by a keyway such as 114. Gear 108 is a worm gear having spiral teeth 116 engaging teeth 118 of gear 106 to rotate toothed gear 106 and disk 44 about axis 42 to change the rotational position of disk 44 about axis 42 relative to disk 40. Worm gear 108 is mounted on a shaft 120, FIG. 1, supported on the frame, and may have an adjustment knob or dial face 122 with calibration or scale indicia. Disk 44 has a fixed, or at least resistive, rotational position about axis 42 relative to disk 40. The adjustment mechanism adjustably controls the fixed or resistive rotational position of disk 44 about axis 42 to vary resistance to rotation of disk 40.

It is recognized that various equivalents, alternatives and modifications are possible within the scope of the appended claims.

What is claimed is:

1. Exercise apparatus for resistance training comprising a first disk rotational about an axis, a second disk axially aligned with said first disk and resisting rotation about said axis, a resiliently deformable coupling coupled between said first and second disks and tensionable in a spiral about said axis upon rotation of said first disk about said axis, such that rotation of said first disk about said axis tensions and stretches said coupling along said spiral and is resisted by said second disk, wherein said coupling has a first end coupled to said first disk, and a second end coupled to said second disk, wherein said coupling comprises a plurality of stretchable bands tensionable in said spiral about said axis.

2. The exercise apparatus according to claim 1 wherein said bands are wrapped in parallel about said axis.

3. The exercise apparatus according to claim 2 wherein said bands are functionally in parallel about said axis.

4. The exercise apparatus according to claim 3 wherein said bands are also geometrically in parallel about said axis.

5. The exercise apparatus according to claim 1 wherein said bands are wrapped in series about said axis.

6. The exercise apparatus according to claim 1 wherein said bands comprise a first stretchable band having first and second ends, and a second stretchable band having first and second ends, said first end of said first band being connected to said first disk, said second end of said first band being connected to said first end of said second band, said second end of said second band being coupled to said second disk.

7. The exercise apparatus according to claim 6 wherein said second end of said second band is coupled to said second disk through one or more additional stretchable bands spirally tensionable in series about said axis.

8. The exercise apparatus according to claim 6 comprising at least one intermediate disk axially aligned with and axially interposed between said first and second disks.

9. The exercise apparatus according to claim 8 wherein said at least one intermediate disk is a connection disk wherein said second end of said first band and said first end of said second band are each attached to said connection disk such that said connection disk provides the connection between said second end of said first band and said first end of said second band.

10. The exercise apparatus according to claim 8 wherein said at least one intermediate disk comprises one or more spacer disks axially spacing said first and second disks.

11. The exercise apparatus according to claim 6 comprising a plurality of intermediate disks axially aligned with and axially interposed between said first and second disks, said intermediate disks comprising at least one connection disk wherein said second end of said first band and said first end of said second band are each attached to said connection disc such that said connection disk provides the connection between said second end of said first band and said first end of said second band, and wherein said intermediate disks comprise a first set of one or more spacer disks axially spacing said connection disk and said first disk, and a second set of one or more spacer disks axially spacing said connection disk and said second disk.

12. Exercise apparatus for resistance training comprising a first disk rotational about an axis, a second disk axially aligned with said first disk and resisting rotation about said axis, a resiliently deformable coupling coupled between said first and second disks and tensionable in a spiral about said axis upon rotation of said first disk about said axis, such that rotation of said first disk about said axis tensions and stretches said coupling along said spiral and is resisted by said second disk, and comprising one or more intermediate disks axially aligned with and axially interposed between said first and second disks, wherein said one or more intermediate disks comprise a set of one or more connection disks to which said coupling is coupled and tensioned along said spiral, a first set of one or more spacer disks axially spacing a respective said connection disk and said first disk, and a second set of one or more spacer disks axially spacing said respective connection disk and said second disk.

13. Exercise apparatus for resistance training comprising a first disk rotational about an axis, a second disk axially aligned with said first disk and resisting rotation about said axis, a resiliently deformable coupling coupled between said first and second disks and tensionable in a spiral about said axis upon rotation of said first disk about said axis, such that rotation of said first disk about said axis tensions and stretches said coupling along said spiral and is resisted by said second disk, and comprising an adjustment mechanism adjustably controlling the position of said second disk relative to said spiral to selectively increase or decrease spiral tension along said coupling to vary resistance to rotation of said first disk, wherein said adjustment mechanism adjustably controls the rotational position of said second disk about said axis, wherein said adjustment mechanism comprises a toothed gear fixed to said second disk and rotational therewith about said axis, and an adjustment gear rotational about a second axis and having gear teeth engaging the teeth of said toothed gear to rotate said toothed gear and said second disk about said first mentioned axis to change the rotational position of said second disk about said first axis relative to said first disk.

14. The exercise apparatus according to claim 13 wherein said adjustment gear is a worm gear rotational about said second axis, wherein said second axis is transverse to said first axis, and said worm gear has spiral gear teeth engaging said teeth of said toothed gear to rotate said toothed gear and said second disk about said first axis.

15. Exercise apparatus for resistance training comprising a first disk rotational about an axis, a second disk axially aligned with and axially spaced from said first disk, a plurality of intermediate disks axially aligned with and axially interposed between said first and second disks, a resiliently deformable coupling coupled between said first and second disks and tensionable in a spiral about said axis, wherein said coupling comprises a plurality of sets of resiliently deformable stretchable bands extending between said first and second disks and wrapped in spirals around said intermediate disks.

16. The exercise apparatus according to claim 15 wherein said sets are wrapped in parallel around said intermediate disks to form a plurality of parallel spirals therearound, and wherein each said set comprises a plurality of said stretchable bands extending end-to-end in series and spirally wrapped around said intermediate disks.

17. The exercise apparatus according to claim 16 wherein said intermediate disks comprise at least one connection disk, and wherein said stretchable bands extending in series are connected end-to-end in series connection at a respective said connection disk.

18. The exercise apparatus according to claim 17 wherein said first disk and said connection disk are rotational about said axis, and wherein said second disk is rotationally resistive relative to said axis.

19. The exercise apparatus according to claim 18 wherein said second disk is rotationally fixed relative to said axis.

20. Exercise apparatus for resistance training comprising a first disk rotational about an axis, a second disk axially aligned with and axially spaced from said first disk, a plurality of intermediate disks axially aligned with and axially interposed between said first and second disks, a resiliently deformable coupling coupled between said first and second disks and tensionable in a spiral about said axis, and comprising an adjustment mechanism comprising a first gear fixed to said second disk, and a second gear engaging said first gear to adjustably rotate said first gear and said second disk about said axis to change the rotational position of said second disk about said axis relative to said first disk.

21. Exercise apparatus for resistance training comprising a first disk rotational about an axis, a second disk axially aligned with and axially spaced from said first disk, a plurality of intermediate disks axially aligned with and axially interposed between said first and second disks, a resiliently deformable coupling coupled between said first and second disks and tensionable in a spiral about said axis, wherein said intermediate disks comprise a set of one or more connection disks to which said coupling is coupled and tensioned along said spiral, a first set of one or more spacer disks axially spacing a respective said connection disk and said first disk, and a second set of one or more spacer disks axially spacing said respective connection disk and said second disk.

22. Exercise apparatus for resistance training comprising a frame supporting a user-engagable training member having a direction of motion to be opposed by resistance, a shaft supported on said frame and extending longitudinally along an axis, a first disk mounted on said shaft and linked to said training member, a second disk mounted on said shaft and resisting rotation about said axis, a resiliently deformable coupling coupled between said first and second disks and tensionable in a spiral about said axis upon rotation of said first disk about said axis, such that movement of said training member by the user along said direction of motion rotates said first disk about said axis tensioning and stretching said coupling along said spiral which is resisted by said second disk.

23. The exercise apparatus according to claim 22 comprising one or more intermediate disks mounted on said shaft and interposed longitudinally between said first and second disks.

24. The exercise apparatus according to claim 23 wherein said one or more intermediate disks comprise one or more connection disks to which said coupling is coupled and tensioned along said spiral.

25. The exercise apparatus according to claim 23 wherein said one or more intermediate disks comprise one or more spacer disks axially spacing said first and second disks.

26. The exercise apparatus according to claim 23 wherein said one or more intermediate disks comprise a set of one or more connection disks to which said coupling is coupled and tensioned along said spiral, a first set of one or more spacer disks axially spacing a respective said connection disk and said first disk, and a second set of one or more spacer disks axially spacing said respective connection disk and said second disk.

27. The exercise apparatus according to claim 22 wherein said coupling comprises a plurality of resiliently deformable stretchable bands extending between said first and second disks and wrapped in spirals.

28. The exercise apparatus according to claim 22 comprising a plurality of intermediate disks mounted on said shaft and interposed longitudinally between said first and second disks, and wherein said coupling comprises a plurality of sets of resiliently deformable stretchable bands extending between said first and second disks and wrapped in spirals around said intermediate disks.

29. The exercise apparatus according to claim 28 wherein said sets of resiliently deformable stretchable bands are wrapped in parallel around said intermediate disks to form a plurality of parallel spirals therearound, and wherein each said set comprises a plurality of stretchable bands extending end-to-end in series and spirally wrapped around said intermediate disks, and wherein said stretchable bands extending in series are connected end-to-end in series connection at a respective said intermediate disk.

30. The exercise apparatus according to claim 22 wherein said second disk is rotationally resistive relative to said axis, and said first disk is rotational about said axis, and comprising an adjustment mechanism adjustably rotating said second disk about said axis to change the rotational position of said second disk about said axis relative to said first disk.

* * * * *